United States Patent [19]

Hart

[11] Patent Number: 4,668,016

[45] Date of Patent: May 26, 1987

[54] MINING MACHINE WITH ADJUSTABLE JIB

[75] Inventor: Dennis Hart, Abingdon, Va.

[73] Assignee: The Dosco Corporation, Abingdon, Va.

[21] Appl. No.: 818,259

[22] Filed: Jan. 13, 1986

[51] Int. Cl.[4] ..... F21C 27/20

[52] U.S. Cl. ..... 299/29; 299/72; 299/78; 299/82

[58] Field of Search ..... 299/31, 72, 76, 78, 299/82, 29; 173/28; 83/928

[56] References Cited

U.S. PATENT DOCUMENTS

| | | | |
|---|---|---|---|
| 2,745,649 | 5/1956 | Robbins | 299/82 |
| 2,750,180 | 6/1956 | McCallum | 299/72 |
| 3,550,961 | 12/1970 | Hughes | 299/72 X |
| 3,658,385 | 4/1972 | Oven et al. | 299/43 |
| 4,131,317 | 12/1978 | Jamison et al. | 299/31 |
| 4,226,476 | 10/1980 | Fairchild et al. | 299/31 |

FOREIGN PATENT DOCUMENTS 1229238 4/1971 United Kingdom .

1240450 7/1971 United Kingdom .

*Primary Examiner*—Stephen J. Novosad
*Assistant Examiner*—Michael A. Goodwin
*Attorney, Agent, or Firm*—Webb, Burden, Robinson & Webb

[57] ABSTRACT

A crawler track mounted mining machine having a frame and an adjustable jib carrying an endless cutting chain having cutters and loading flights mounted on the frame. A bridge on the frame and spaced arms having one end pivotally connected to the bridge and the other end supporting a front plate upon which the jib is adjustably mounted by a rotatable bearing supporting a cross member which carries hinges pivotally supporting the jib. Hydraulic rams extend between the cross member and the jib to rotate the jib between a vertical position and a horizontal position and a hydraulic ram extends between the rotatable bearing and the front plate to rotate the front plate and the jib in a horizontal plane between a position perpendicular to the crawler tracks and a position parallel to the crawler tracks. Hydraulic rams extend between the bridge and the arms to raise and lower the arms and the jib relative to the frame.

20 Claims, 7 Drawing Figures

MINING MACHINE WITH ADJUSTABLE JIB

BACKGROUND OF THE INVENTION

1. Field of the Invention

The invention is directed generally to a mining machine which cuts the full face of the coal from the floor to the roof. The mining machine has a jib at its front end which carries sprockets which support an endless cutting chain. The jib is perpendicular to the center line of the machine during mining which makes it difficult to tram the machine from one entry to another entry in the mine.

2. Description of the Prior Art

Mining machines having crawler tracks for moving the machine and a forward jib carrying an endless movable cutting chain with spaced cutting bits thereon for mining the coal from the full face are known in the art. The machines have spaced loading flights located on the endless chain which move cut coal from the floor of the mine adjacent the face to a conveyor extending along one side of the machine which moves the cut coal from the front end of the mining machine to the rear of the machine where it is loaded onto cars or other conveyors for subsequent removal from the mine.

The length of the jib is greater than the width of the mining machine, and it is not possible to easily tram the mining machine from one entry to another entry. The length of the jib relative to the width of the mining machine does not pose a problem in longwall mining or in room and pillar mining, but in individual entry mining, this is a problem. The problem has been solved in prior art machines by removing the jib from the machine or removing the ends of the jib, but such is costly and time consuming and causes excessive downtime of the machine.

SUMMARY OF THE INVENTION

The invention is a mining machine having an adjustable jib located at its forward end. The jib can be adjusted from a first position parallel to the face being mined during mining to a second position wherein it is parallel to the center line of the mining machine and is lowered between the tracks so that the machine can be easily trammed from one entry to another entry in the mine.

BRIEF DESCRIPTION OF THE DRAWINGS

In the following description of the drawings, like reference numerals refer to like parts throughout.

DESCRIPTION OF THE PREFERRED EMBODIMENTS

Figure 1:
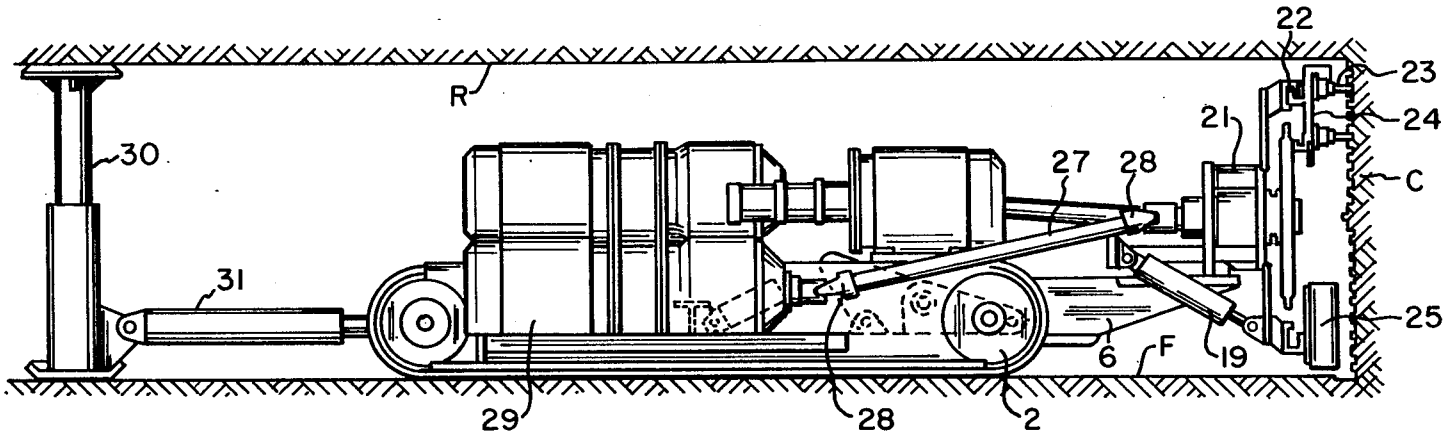
FIG. 1 is an elevation of the mining machine of the invention with the jib in the mining position.
Figure 3:
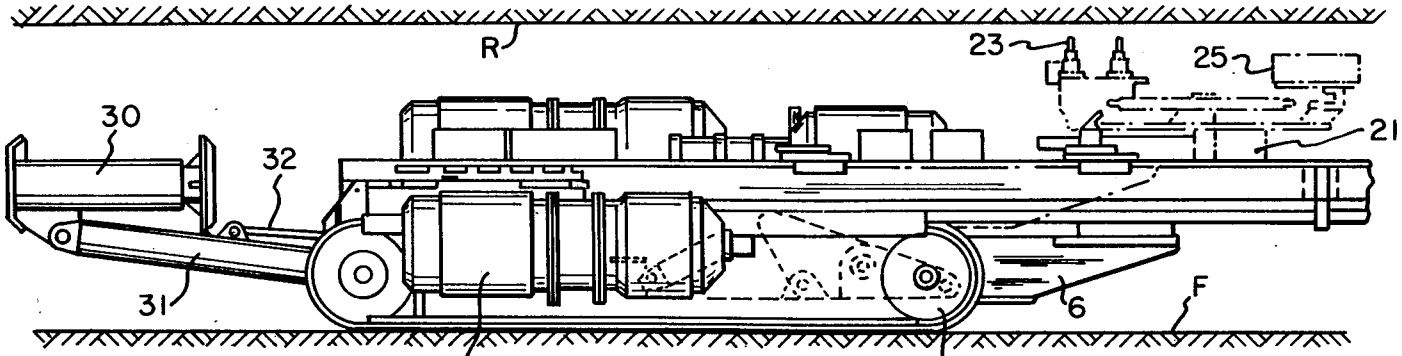
FIG. 3 is an elevation of the mining machine of the invention with the jib in the tram position.

As shown in FIGS. 1–4 of the drawings, the mining machine includes a pair of spaced crawler tracks 1 and 2 which are independently driven by hydraulic tram motors 3 and 4 located on the inside of each rear track sprocket. The hydraulically driven crawler tracks are capable of a tram speed of approximately 60 feet per minute, and the independent drive provides split steering of the machine for close maneuverability in mine entries. The frame of the mining machine is mounted between crawler tracks 1 and 2 and supports a hydraulic oil reservoir 5 on the rear and a bridge 6 extending forwardly on the front of the crawler tracks. A jib 10 is pivotally mounted on a cross member 11 which is supported on the upper end of a rotatable vertical bearing 12 mounted on a front plate 13 fixed on the forward ends of a pair of substantially parallel spaced vertically movable arms 14 which are pivotally mounted on bridge 6 by pivots 15 so that the front plate can be raised and lowered by hydraulic rams 16 connected between the arms and the bridge. Each ram 16 actuates a scissor linkage 17 which is attached to the rear end of a spaced arm 14.

The jib 10 is mounted on cross member 11 by hinges 18, and a hydraulic ram 19 is connected between each end of cross member 11 and the jib. The hydraulic rams rotate the jib from the vertical mining position shown in FIGS. 1 and 2 of the drawings into the horizontal tram position shown in FIGS. 3 and 4 of the drawings wherein the cutters face the mine roof R. A centrally located ram 20 extends between the lower surface of front plate 13 and rotatable bearing 12 to rotate the bearing and cross member 11 90° in a horizontal plane. Rotation of the cross member rotates jib 10 which is attached thereto.

Figure 2:
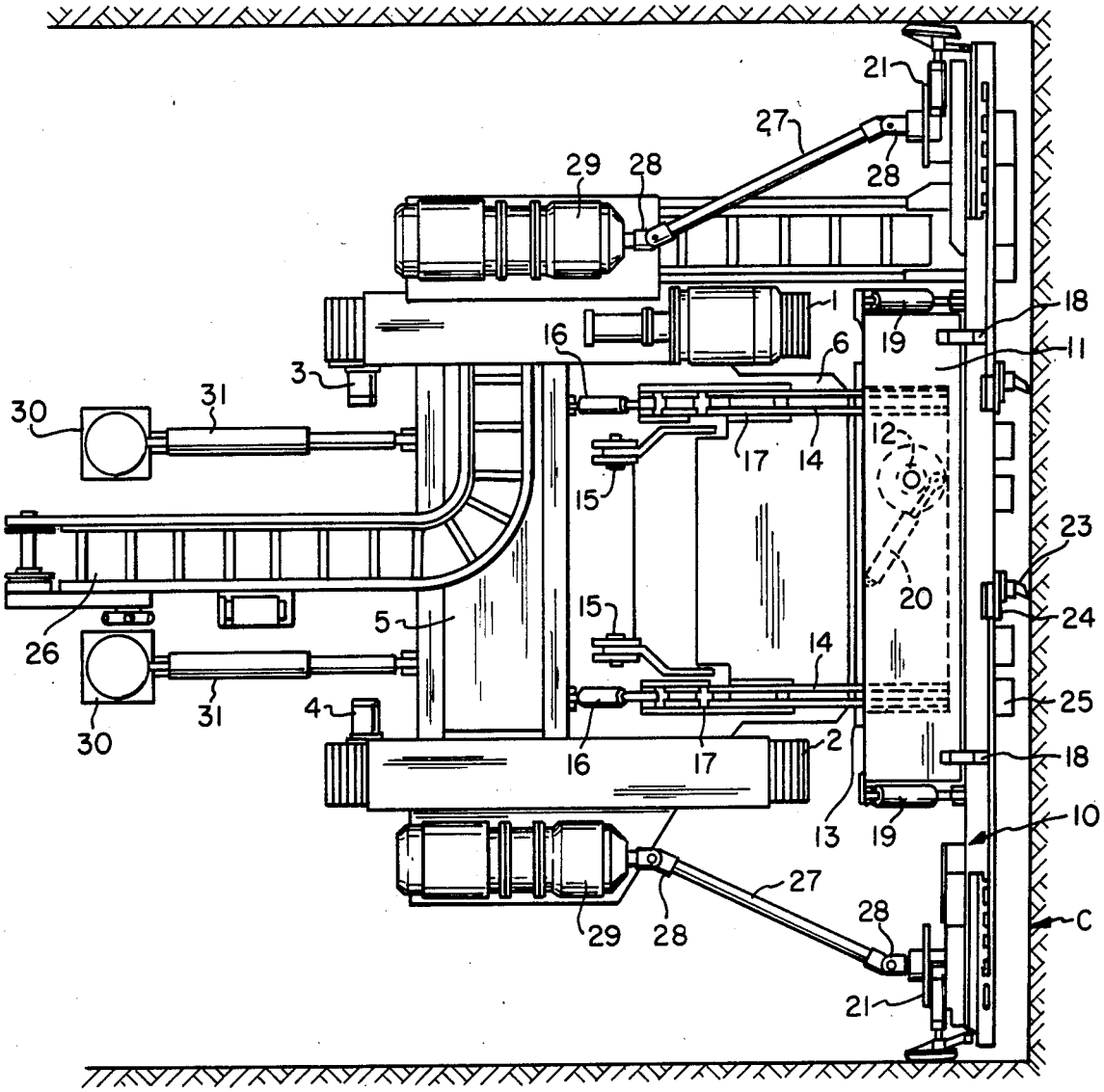
FIG. 2 is a plan view of the mining machine with the jib in the position shown in FIG. 1.
Figure 4:
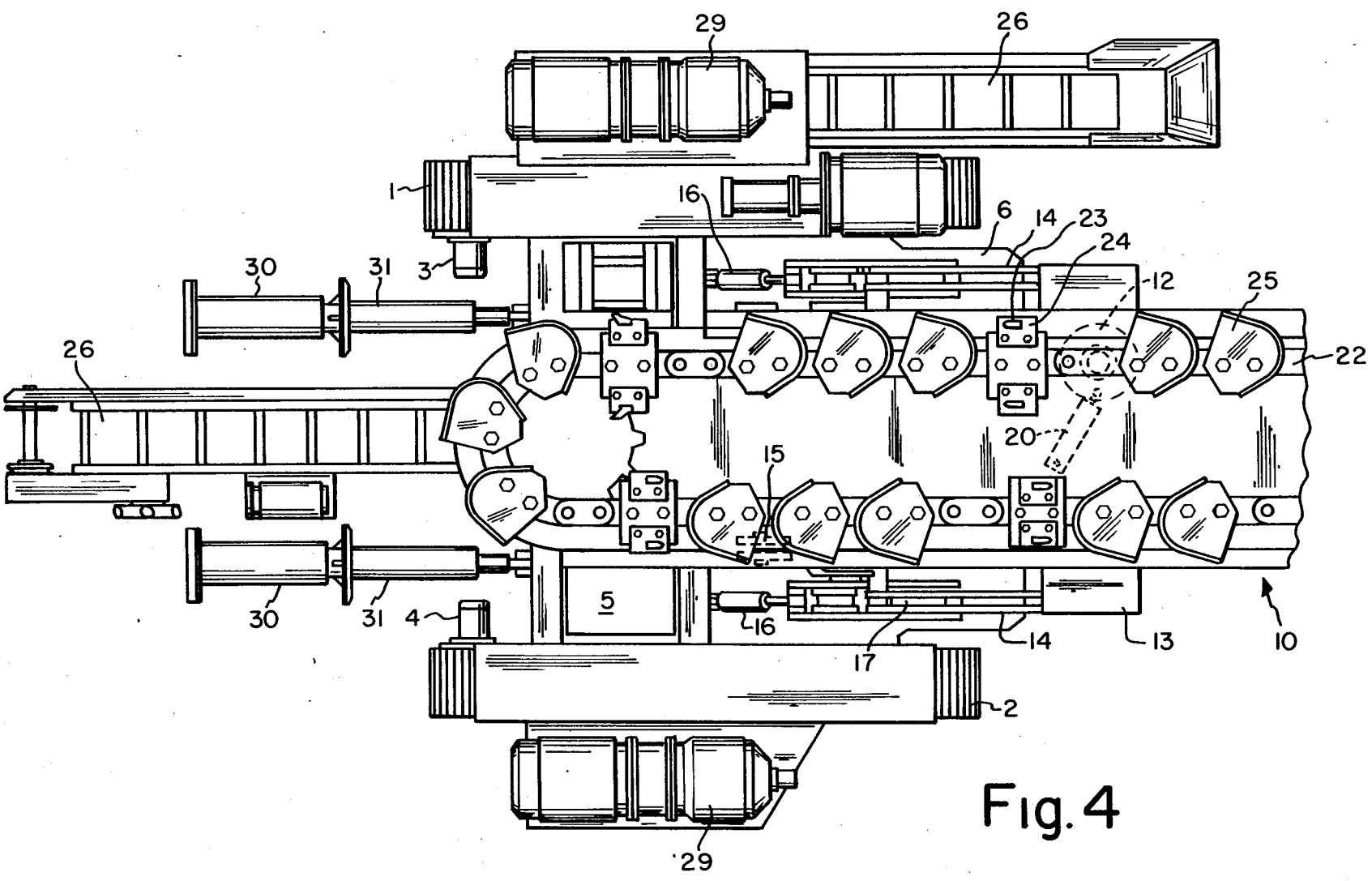
FIG. 4 is a plan view of the mining machine with the jib in the position shown in FIG. 3 with a portion of the jib broken away.
Figure 5:
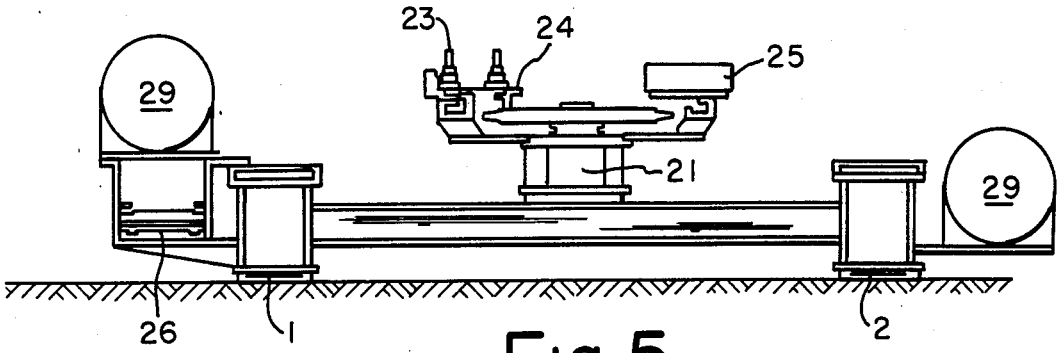
FIG. 5 is a rear view of the mining machine of the invention with the jib in the tram position and the roof jacks removed.
Figure 6:
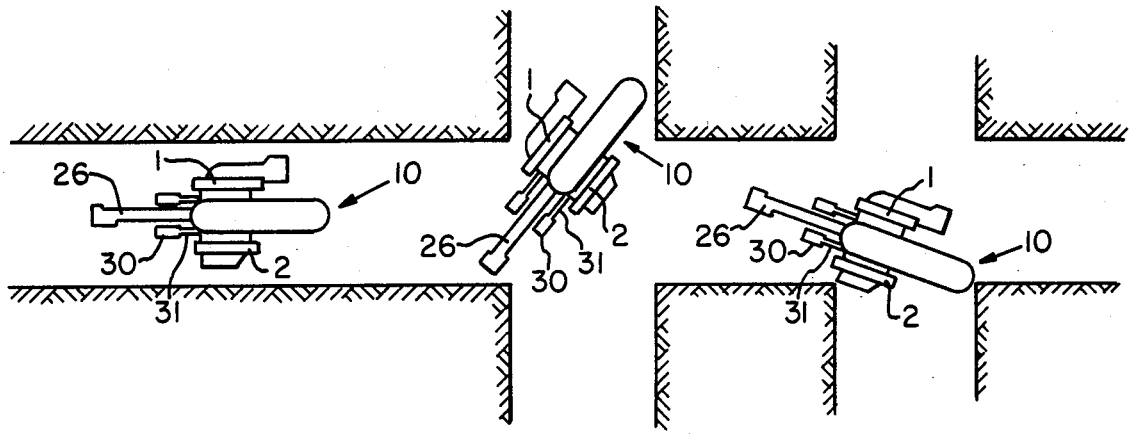
FIG. 6 is a schematic view of the mining machine of the invention in a mine showing a machine being trammed.

The jib carries a sprocket 21 at each end, and an endless cutting chain 22 passes around the sprockets. A plurality of spaced cutters 23 are supported on the chain by plates 24. Loading flights 25 are also mounted on the endless cutting chain to clear the cut coal from the mine floor and move it from the right-hand side of the machine to the left-hand side of the machine to deposit the cut coal onto a rearwardly directed conveyor 26 which is attached along the left-hand side of the mining machine and which passes through the left-hand track, as shown in FIG. 2 of the drawings, and discharges the coal in the rear center of the machine. The conveyor is driven by a standard electric motor drive. The details of the endless cutting chain and the sprockets are described in detail in U.S. Pat. No. 3,658,385, which description is incorporated herein by reference.

In the embodiment shown in FIGS. 1–4 of the drawings, each sprocket for driving the endless cutting machine is driven by an elongated drive shaft 27 having a universal joint 28 at each end. The universal joint at the forward end of each drive shaft is connected to a sprocket 21, and the universal joint at the rear end of each drive shaft is connected to a hydraulic motor 29 which is supported on the mining machine frame. Each hydraulic motor 29 rotates its drive shaft to rotate a sprocket to move the cutting chain through the coal and to move the loading flights along the floor of the mine to transport cut coal to conveyor 26. Each end of the jib is provided with a skid for contacting a wall of the entry to maintain the jib in the proper position relative to the coal face C which is being cut.

A pair of hydraulic staker jacks 30 for supporting the roof and providing a base for sumping the cutters into the coal face are attached to the rear of the machine frame by hydraulic advancing rams 31. As shown in FIG. 1 of the drawings, the jacks extend between the floor F and the roof R of the entry to prevent roof falls. The hydraulic advancing rams 31 sump the cutters 23 into the coal face C at a rate of approximately one foot per minute. Each ram 31 has a link bar 32 connecting it with the machine frame to hold the advancing ram and the jack in the tram position shown in FIGS. 3 and 4 of the drawings.

Figure 7:
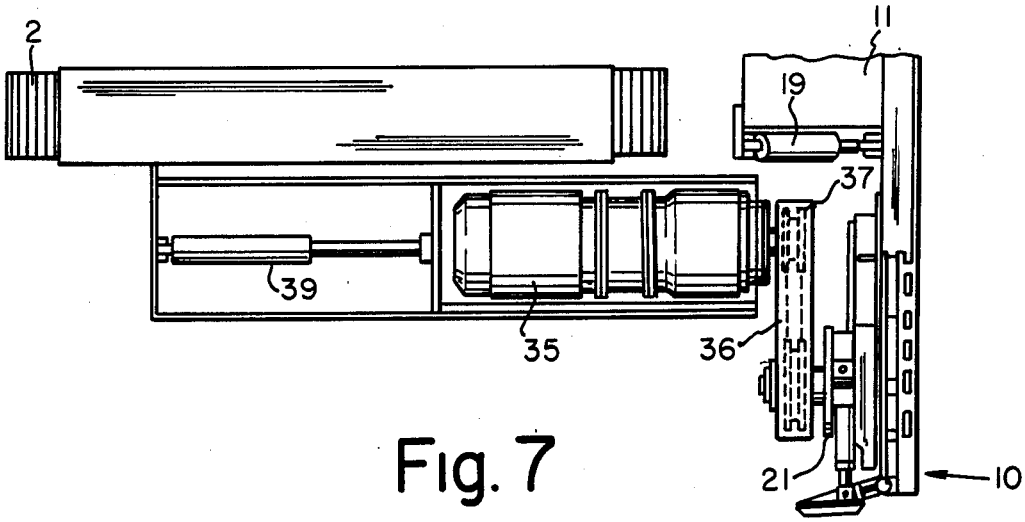
FIG. 7 is a partial plan view of the mining machine of the invention showing an alternative connection between a power unit on the machine and a chain sprocket on the jib.

In the modification shown in FIG. 7 of the drawings, each sprocket 21 is driven by an electric motor 35 slidably mounted on the machine frame and acting through a drive chain 36 extending between the rear of sprocket 21 and a chain drive sprocket 37 on the front of the motor. In order to disengage the drive chain connection to move the jib into the tram position, a locking pin is removed from the flange connecting the drive chain to the sprocket, and electric motor 35 along with sprocket 37 and drive chain 36 are moved rearwardly by a hydraulic positioning ram 39 which is connected to the rear of the electric motor and to the machine frame. Motor 35, sprocket 37 and chain drive 36 slide rearwardly relative to the machine frame to permit clearance for rotating the jib into the horizontal position. The advantage of the arrangement shown in FIG. 7 of the drawings is that it is not necessary to include two universal joints for each drive shaft as in the arrangement shown in FIGS. 1–4 of the drawings.

The mining machine of the invention operates in the following manner. To begin mining, jacks 30 are set as shown in FIGS. 1 and 2 of the drawings with advancing rams 31 in the retracted position. During mining, the advancing rams are gradually extended as the endless cutting chain 22 moves around sprockets 21 to sump cutters 23 on the cutting chain into the coal face C to cut coal from the face until the advancing rams 31 are extended to their maximum length. At this point, jacks 30 are retracted after which the rams 31 are retracted to move the jacks forwardly toward the mining machine into a new position where the jacks are set and another sequence of mining takes place. The machine cannot sump on crawler tracks 1 and 2 since it is not heavy enough to force the cutters into the coal. As known to those skilled in the art, roof bolters follow the roof jacks and bolt the roof to prevent roof falls. Because of the central location of conveyor 26 at the rear of the machine, the roof can be bolted on both sides of the conveyor. The mining machine is operated by remote control through an umbilical cord so that the operator is always located behind jacks 30 under a safe roof.

The mining machine of the invention may be used in entries and headers wherein it has poor mobility with jib 10 in the cutting position shown in FIGS. 1 and 2 of the drawings. Therefore, the machine is provided with the arrangement described herein to adjust the position of the jib into the tram position shown in FIGS. 3–6 of the drawings. In these figures, jib 10 carrying sprockets 21 and endless cutting chain 22 lies over the center line of the mining machine and is lowered onto the machine frame. This is accomplished according to the method described hereinafter.

When the jib is to be moved into the tram position from the mining position, the drive shafts 27 are disconnected at the universal joints 28 or the electric motors 25 are retracted by positioning rams 39, and the jib is pivoted 90° into the horizontal position shown in FIGS. 3–6 by hydraulic rams 19. In this position, the endless cutting chain faces the mine roof. The next step in adjusting the jib into the tram position is to rotate it 90° in a horizontal plane by means of hydraulic ram 20 which rotates bearing 12 and front plate 13 about the vertical axis of the bearing to turn the jib so that the jib overlies the center line of the mining machine. The jib is now lowered by hydraulic rams 16 until it is in the position shown in FIG. 5 of the drawings. In the lowered position, the maximum height between the mine floor and the top of the jib will be 40 inches, and the machine can now be trammed according to the movements shown in FIG. 6 of the drawings. It will be readily seen that since the jib overlies the center line of the machine rather than being in the mining position perpendicular to the center line of the machine, the machine can easily be moved through relatively narrow entries without interference from the jib.

While preferred embodiments of the invention have been described herein, it is to be understood that the invention may be embodied within the scope of the appended claims.

I claim:

1. A mining machine having a pair of crawler tracks, a means for individually driving each of said crawler tracks, a frame mounted on said crawler tracks, an elongated jib carrying a sprocket at each end, an endless cutting chain supported on said sprockets, cutters and loading flights mounted on said endless cutting chain, and means on said frame supporting said elongated jib, said means supporting said elongated jib consisting of a bridge on said frame, at least one scissors linkage pivotally mounted on said bridge, an arm having a first end attached to said scissors linkage, a front plate mounted on the second end of said arm and means adjustably mounting said elongated jib on said front plate, said means adjustably mounting said elongated jib on said front plate including a first means for rotating said elongated jib between a vertical position and a horizontal position wherein said cutters are directed upwardly and a second means for rotating said elongated jib in a horizontal plane between a position perpendicular to the center line of said machine and a position parallel to the center line of said machine and means mounted on said bridge and connected to said arm to raise and lower said arm to move said elongated jib in the vertical direction relative to said frame, whereby said elongated jib can be adjusted between a mining position and a tram position for moving said machine.

2. A mining machine as set forth in claim 1 wherein said first means for rotating said elongated jib between a vertical position and a horizontal position includes a cross member mounted on said front plate, hinge means connecting said elongated jib to said cross member and at least one ram having a cylinder and a rod connected between said cross member and said elongated jib, whereby retraction and extension of said rod relative to said cylinder rotates said jib on said hinge means about said cross member.

3. A mining machine as set forth in claim 1 wherein said second means for rotating said elongated jib in a horizontal plane is a rotatable vertical bearing mounted on said front plate, a cross member substantially parallel to said elongated jib mounted on the upper end of said rotatable vertical bearing and supporting said elongated jib and a hydraulic ram having a cylinder and a rod connected between said front plate and said rotatable vertical bearing, whereby retraction and extension of said rod relative to said cylinder rotates said bearing and said cross member to rotate said elongated jib.

4. A mining machine as set forth in claim 1 wherein said means mounted on said bridge and connected to said arm to raise and lower said arm to move said elongated jib in the vertical direction relative to said frame is a hydraulic ram having a cylinder and a rod connected between said bridge on said frame and said scissors linkage pivotally mounted on said bridge, whereby retraction and extension of said rod relative to said cylinder raises and lowers said scissors linkage and said arm to raise and lower said elongated jib.

5. A mining machine as set forth in claim 1 including a drive means on said frame for driving each of said sprockets on said elongated jib and means connecting said drive means with said sprocket to rotate said sprocket to move said endless cutting chain.

6. A mining machine as set forth in claim 5 wherein said means connecting said drive means with each of said sprockets is a drive shaft, a universal joint connecting one end of said drive shaft to said drive means and a universal joint connecting the other end of said drive shaft to said sprocket, whereby said universal joints are disconnected prior to adjusting said elongated jib between the mining position and the tram position.

7. A mining machine as set forth in claim 5 wherein said drive means for driving each of said sprockets is an electric motor mounted on said frame, a detachable chain drive extending between said electric motor and said sprocket, means to detach said chain drive from said sprocket prior to adjusting said elongated jib between the mining position and the tram position.

8. A mining machine as set forth in claim 7 including means on said frame mounting each of said electric motors for sliding movement relative to said frame and means for moving each of said electric motors and said detachable chain drive away from said sprocket after detaching said chain drive from said sprocket.

9. A mining machine as set forth in claim 1 including a plurality of roof jacks, an advancing ram connecting each of said roof jacks to the rear of said frame, whereby said roof jacks are set and said advancing rams sump said cutters on said endless cutting chain into a face to be mined.

10. A mining machine as set forth in claim 9 including a link bar extending between said frame and each of said advancing rams for holding said advancing rams and said roof jacks above the floor of a mine during tramming of the mining machine.

11. A mining machine as set forth in claim 1 including a conveyor extending from the forward end of said frame past the rear end of said frame for receiving cut coal from said loading flights on said cutting chain to move the cut coal from the front of the mining machine at a face to the rear of the mining machine.

12. A mining machine as set forth in claim 11 wherein said conveyor has a first section located at one side of said mining machine, a second section connected to said first section and crossing to the center of said mining machine and a third section connected to said second section and extending rearwardly from said second section along the center line of said mining machine.

13. A mining machine having a pair of crawler tracks, a means for individually driving each of said crawler tracks, a frame mounted on said crawler tracks, an elongated jib carrying a sprocket at each end, an endless cutting chain supported on said sprockets, cutters and loading flights mounted on said endless cutting chain and means on said frame supporting said elongated jib, said means supporting said elongated jib consisting of a bridge on said frame, a pair of spaced scissors linkages pivotally connected to said bridge, an arm having a rear end attached to each of said scissors linkages, a cross member, means mounting said cross member on said arms and means adjustably mounting said elongated jib on said cross member for rotating said elongated jib between a vertical position and a horizontal position wherein said cutters are directed upwardly and means for rotating said cross member and said elongated jib in a horizontal plane between a position perpendicular to said crawler tracks and a position parallel to said crawler tracks and means on said bridge for raising and lowering said arms and said means mounting said cross member on said arms to raise and lower said cross member and said elongated jib relative to said frame, whereby said jib can be adjusted between a mining position and a tram position.

14. A mining machine having a pair of crawler tracks, a means for individually driving each of said crawler tracks, a frame mounted on said crawler tracks, an elongated jib carrying a sprocket at each end, an endless cutting chain supported on said sprockets, cutters and loading flights mounted on said endless cutting chain, and means on said frame supporting said elongated jib, said means supporting said elongated jib consisting of a bridge mounted on said frame, at least one arm pivotally mounted on said bridge, a front plate mounted on said arm and means adjustably mounting said elongated jib on said front plate, said means adjustably mounting said elongated jib on said front plate including a first means for rotating said elongated jib between a vertical position and a horizontal position and a second means for rotating said elongated jib in a horizontal plane between a position perpendicular to the center line of said machine and a position parallel to the center line of said machine, whereby said elongated jib can be adjusted between a mining position and a tram position for moving said machine.

15. A mining machine as set forth in claim 14 wherein said first means for rotating said elongated jib between a vertical position and a horizontal position includes a cross member mounted on said front plate, hinge means connecting said elongated jib to said cross member and at least one ram having a cylinder and a rod connected between said cross member and said elongated jib, whereby retraction and extension of said rod relative to said cylinder rotates said jib relative to said cross member on said hinge means.

16. A mining machine as set forth in claim 14 wherein said second means for rotating said elongated jib in a horizontal plane is a vertical rotatable bearing having a lower end mounted on said front plate, a cross member substantially parallel to said elongated jib mounted on the upper end of said vertical rotatable bearing and supporting said elongated jib and a hydraulic ram having a cylinder and a rod connected between said front plate and said vertical rotatable bearing, whereby retraction and extension of said rod relative to said cylinder rotates said bearing and said cross member to rotate said elongated jib.

17. A mining machine as set forth in claim 14 including a separate drive means on said frame for driving each sprocket on said elongated jib and means connecting said drive means with said sprocket to rotate said sprocket to move said endless cutting chain.

18. A mining machine as set forth in claim 17 wherein said means connecting each drive means with each sprocket is a drive shaft, a universal joint connecting one end of said drive shaft to said drive means and a universal joint connecting the other end of said drive shaft to said sprocket, whereby said universal joints are disconnected prior to adjusting said elongated jib between the mining position and the tram position.

19. A mining machine as set forth in claim 17 wherein said driving means for driving each sprocket is an electric motor mounted on said frame, a detachable chain drive extending between said electric motor and each sprocket, means to detach said chain drive from said sprocket prior to adjusting said elongated jib between the mining position and the tram position.

20. A mining machine as set forth in claim 19 including means on said frame mounting each of said electric motors for sliding movement relative to said frame and means for moving each of said electric motors and said chain drive away from said sprocket after detaching said chain drive from said sprocket.

* * * * *